US009643329B2

(12) United States Patent
Bond

(10) Patent No.: US 9,643,329 B2
(45) Date of Patent: May 9, 2017

(54) METHOD OF MAKING A ROOF PIPE FLASHING

(71) Applicant: William Ralph Bond, Manassas, VA (US)

(72) Inventor: William Ralph Bond, Manassas, VA (US)

( * ) Notice: Subject to any disclaimer, the term of this patent is extended or adjusted under 35 U.S.C. 154(b) by 0 days.

(21) Appl. No.: 14/545,459

(22) Filed: May 7, 2015

(65) Prior Publication Data

US 2016/0340907 A1 Nov. 24, 2016

Related U.S. Application Data

(62) Division of application No. 13/507,134, filed on Jun. 7, 2012.

(51) Int. Cl.

| | |
|---|---|
| ***E04D 13/14*** | (2006.01) |
| ***B26F 3/02*** | (2006.01) |
| ***B26D 3/00*** | (2006.01) |
| ***E04D 13/147*** | (2006.01) |

(52) U.S. Cl.

CPC ..... *B26D 3/00* (2013.01); *B26F 3/02* (2013.01); *E04D 13/1476* (2013.01); *Y10T 83/04* (2015.04); *Y10T 225/10* (2015.04)

(58) Field of Classification Search

CPC ... B26D 3/00; E04D 13/1476; E04D 13/1475; Y10T 83/04; Y10T 225/10; B26F 3/02

USPC ..... 83/13; 52/741.4, 219, 100; 285/3, 4, 285/42–44

See application file for complete search history.

(56) References Cited

U.S. PATENT DOCUMENTS

| | | | | |
|---|---|---|---|---|
| 928,596 | A | 7/1909 | Friedman | |
| 2,173,037 | A | 9/1939 | Dailey | |
| 3,163,101 | A | 12/1964 | Caparrelli | |
| 3,602,530 | A | 8/1971 | Elwart | |
| 3,638,503 | A | 2/1972 | Stipanovic et al. | |
| 3,797,181 | A | 3/1974 | Nievelt | |
| 4,526,407 | A | 7/1985 | Kifer | |
| 4,563,847 | A | 1/1986 | Hasty | |
| 4,768,812 | A * | 9/1988 | Katz | E04D 13/1476 285/43 |
| 4,903,997 | A | 2/1990 | Kifer | |
| 5,010,700 | A * | 4/1991 | Blair | E04D 13/1476 285/42 |
| 5,036,636 | A | 8/1991 | Hasty | |
| 5,176,408 | A | 1/1993 | Pedersen | |
| 5,222,334 | A | 6/1993 | Hasty | |

(Continued)

FOREIGN PATENT DOCUMENTS

| | | | | |
|---|---|---|---|---|
| DE | 2523575 A1 * | 11/1975 | ..... | E04D 13/1475 |
| GB | 300435 A * | 11/1928 | ..... | E04D 13/1476 |

OTHER PUBLICATIONS

ABC Supply Co, Inc. Spring 2012 Pub. U.S. Tools, Equipment & Accessories p. 129.

*Primary Examiner* — Ghassem Alie

(74) *Attorney, Agent, or Firm* — Palmer Patent & Consultants, LLC.; Palmer C. DeMeo

(57) ABSTRACT

A roof pipe flashing with a raised boot and elongated opposite extensions extending therefrom which roof pipe flashing is used to cover and weatherproof an existing but damaged roof pipe flashing on the pitched roof of a building. The roof pipe flashing can be made manually by cutting or tearing along pre-marked lines on the flat base of a roof pipe flashing.

8 Claims, 6 Drawing Sheets

(56) References Cited

U.S. PATENT DOCUMENTS

| | | | | |
|---|---|---|---|---|
| 5,226,263 | A | 7/1993 | Merrin et al. | |
| 5,245,804 | A | 9/1993 | Schiedegger et al. | |
| 5,588,267 | A | 12/1996 | Rodriguez et al. | |
| 2005/0150176 | A1 | 7/2005 | Erekson | |
| 2006/0130411 | A1 | 6/2006 | Edgar et al. | |
| 2007/0087624 | A1* | 4/2007 | Edwards | E04D 13/1476 439/559 |
| 2011/0138738 | A1* | 6/2011 | Saad | E04B 9/068 52/745.19 |
| 2011/0219723 | A1 | 9/2011 | Manning | |
| 2012/0031024 | A1* | 2/2012 | Selke | E04D 13/1476 52/219 |

* cited by examiner

METHOD OF MAKING A ROOF PIPE FLASHING

This is divisional application of U.S. Ser. No. 13/507,134 (presently pending) and entitled Roof Pipe Flashing.

BACKGROUND OF THE INVENTION

1. Field of the Invention

The present invention relates to a roof pipe flashing and particularly the repair of a damaged roof pipe flashing and the making of a roof pipe flashing used in the repair.

2. Description of the Related Art

A problem which can occur over time with vent pipes extending through the roof of a building is deteriorization of the flashing boot surrounding the vent pipe causing water leakage therethrough and subsequent damage to the roofing structure. Several prior art methods have been used to repair existing roof pipe flashings by covering the boot of the existing roof pipe flashing with a similar shaped boot over the existing boot in order to prevent water leakage. One such method is disclosed in the publication US 2001/0219723 where a vent pipe cover comprising a cylindrical sheath portion joined to a flaring boot portion is used. The cylindrical sheath portion is slid over the cylindrical vent pipe and the flaring boot portion is placed over an existing roof boot. The vent pipe cover of the publication also includes an accordion pleat between the cylindrical sheath portion and the flaring boot portion to compensate for roof pitch angle. The vent pipe cover of the publication further includes spaced friction rings between the cylindrical sheath portion and the cylindrical vent pipe in order to hold the cylindrical sheath portion in place. Another prior art method is disclosed in the publication US 2005/01501176 where a truncated conical shield or cover is placed over a damaged boot portion of an existing roof pipe flashing. Other prior art covers for existing roof pipe flashings are disclosed in the following patents: U.S. Pat. Nos. 3,163,101, 3,797,181, 5,226,263, 5,245,804 and US publication 2006/0130411.

SUMMARY OF THE INVENTION

The purpose of this invention is to provide a water tight cover for an existing but damaged roof pipe flashing without removing the damaged roof pipe flashing and to accomplish this in an expeditious way saving time and without removal of the damaged roof pipe flashing from the roof of a building. In order to accomplish this, a modified roof pipe flashing is used to cover the damaged boot of an existing roof pipe flashing. The roof pipe flashing of this invention includes a boot generally about the same size as the boot of an existing but damaged roof pipe flashing and a pair of opposite extensions from the boot which extensions are used to secure the boot to the roof of the building via the base of the existing but damaged roof pipe flashing. The roof pipe flashing of this invention can be a prefabricated cover boot including opposite elongated extensions or it can be fabricated from a commercially available roof pipe flashing by manually cutting or tearing the pre-marked base of the commercially available roof pipe flashing in order to manually fabricate a cover boot with opposite extensions.

It is an object of this invention to provide a roof pipe flashing to cover the damaged boot of an existing roof pipe flashing.

It is another object of this invention to prevent water leakage from an existing but damaged roof pipe flashing.

It is a further object of this invention to use a roof pipe flashing to repair an existing but damaged roof pipe flashing without tearing up or replacing the base of the existing but damaged roof pipe flashing.

It is another object of this invention to save time in repairing an existing but damaged roof pipe flashing.

It is a further object of this invention to modify a commercially available roof pipe flashing which is partially fabricated on site or completely prefabricated at the factory.

It is yet another object of this invention to use a pre-marked roof pipe flashing as a new roof pipe flashing for new roof construction.

DETAILED DESCRIPTION OF THE PREFERRED EMBODIMENTS

Figure 1:
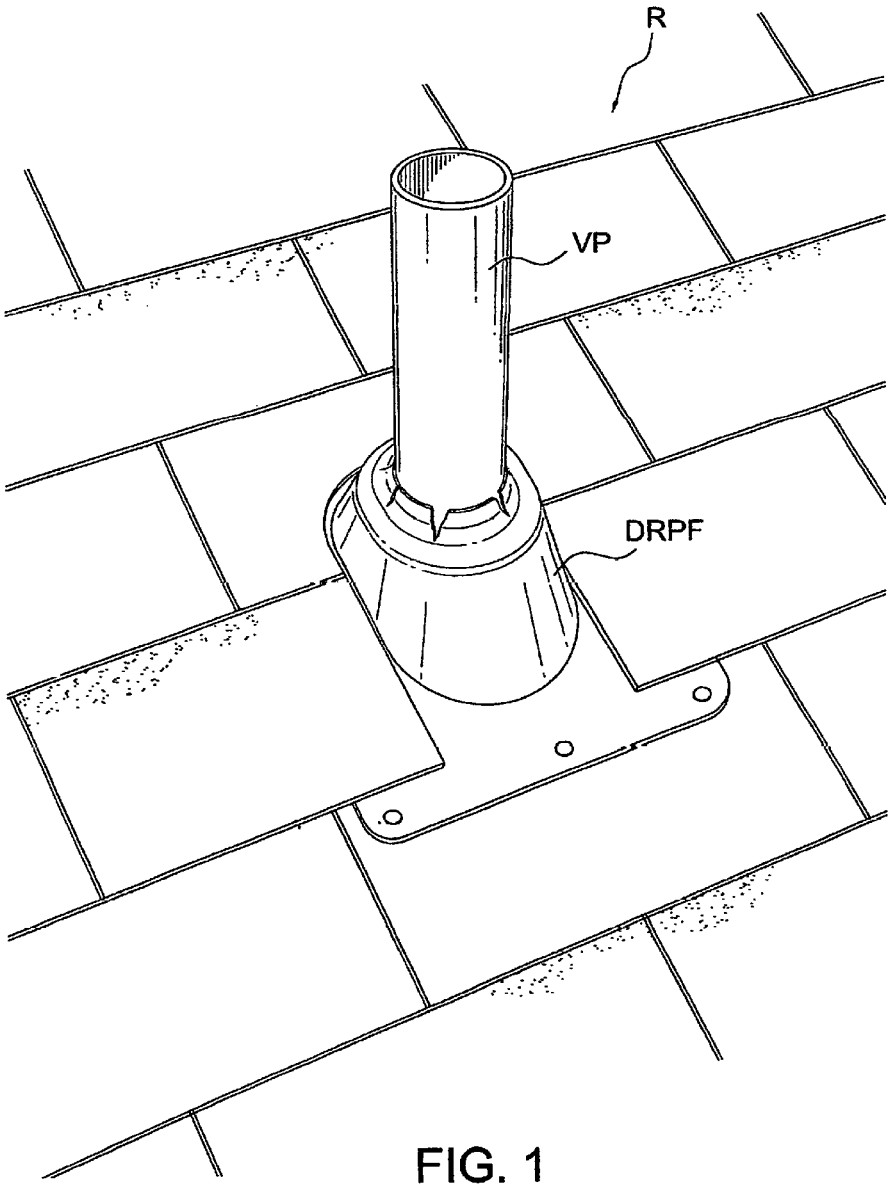
FIG. 1 is a perspective view of a damaged boot of a roof pipe flashing on an inclined or pitched roof of a building.

FIG. 1 shows a damaged boot of an existing roof pipe flashing (DRPF) for a vent pipe VP which would result in water leakage and probable damage to the roof R of a building. This is the type of damage that the roof pipe flashing of this invention intends to repair.

Figure 2:
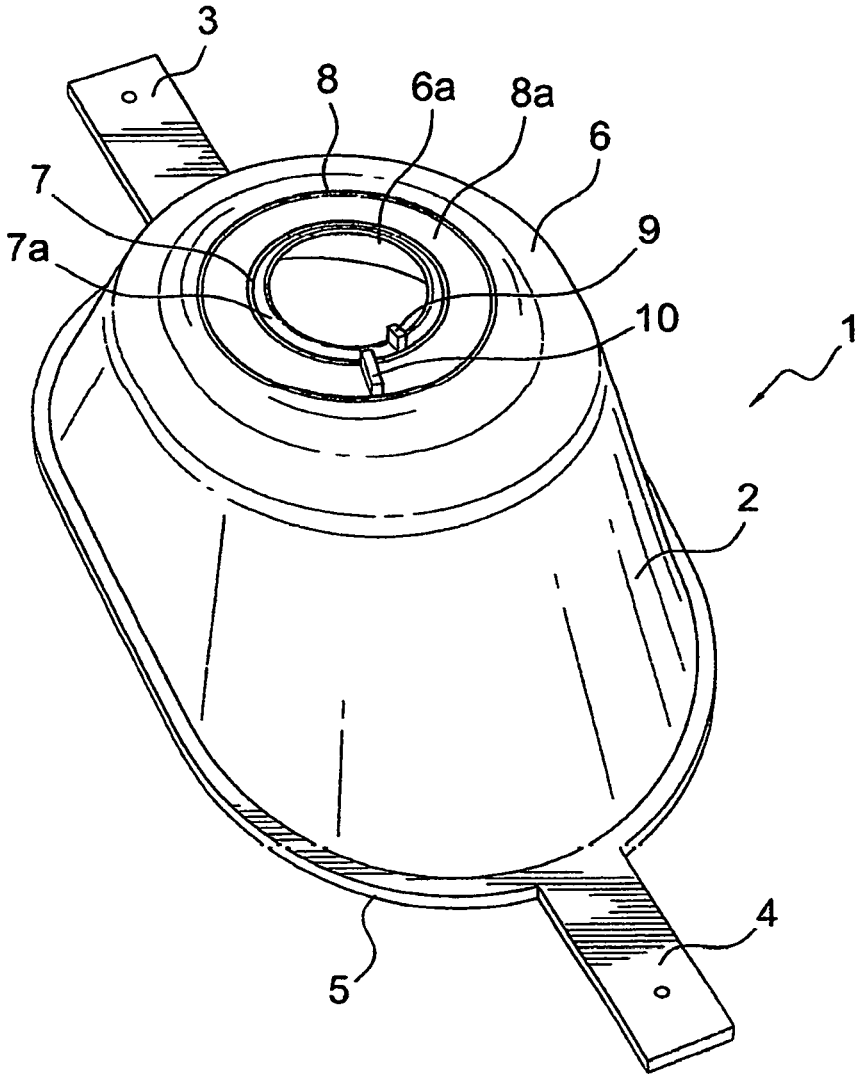
FIG. 2 is a perspective view of the roof pipe flashing of this invention.

Referring to FIG. 2, there is shown the roof pipe flashing 1 of this invention. The roof pipe flashing 1 includes a raised boot 2 and two extensions 3 and 4 extending from opposite sides at the bottom end 5 of the raised boot 2. The extensions 3 and 4 are used to anchor the raised boot to the roof R of the building. The extensions 3 and 4 preferably extend from about three inches from the bottom end 5 of the raised boot 2 but can vary somewhat longer or shorter. The width of each extension is approximately two inches but can vary somewhat wider or narrower. The raised boot 2 is somewhat frusto-conical in shape and has an opening 6*a* at the top end 6 thereof to accommodate a vent pipe VP extending therethrough. The raised boot 2 of the roof pipe flashing 1 of this invention is generally of the same size as the boot of an existing but damaged roof pipe flashing DRPF in order to be readily placed thereover. The top end 6 of the raised boot 2 has a couple of marked circles 7 and 8 of different diameters which can be used to cut out or tear out a circumferential sections 7*a* or 8*a* at the top end 6 in order to accommodate different sized vent pipes. Upright tabs 9 and 10 extending from the separate sized circumferential sections 7*a* and 8*a* can be used to aid in the manual removal of the circumferential sections. The roof pipe flashing of this invention 1 is made from soft rubbers, hard plastics or conventional elastomeric materials.

Figure 3A:
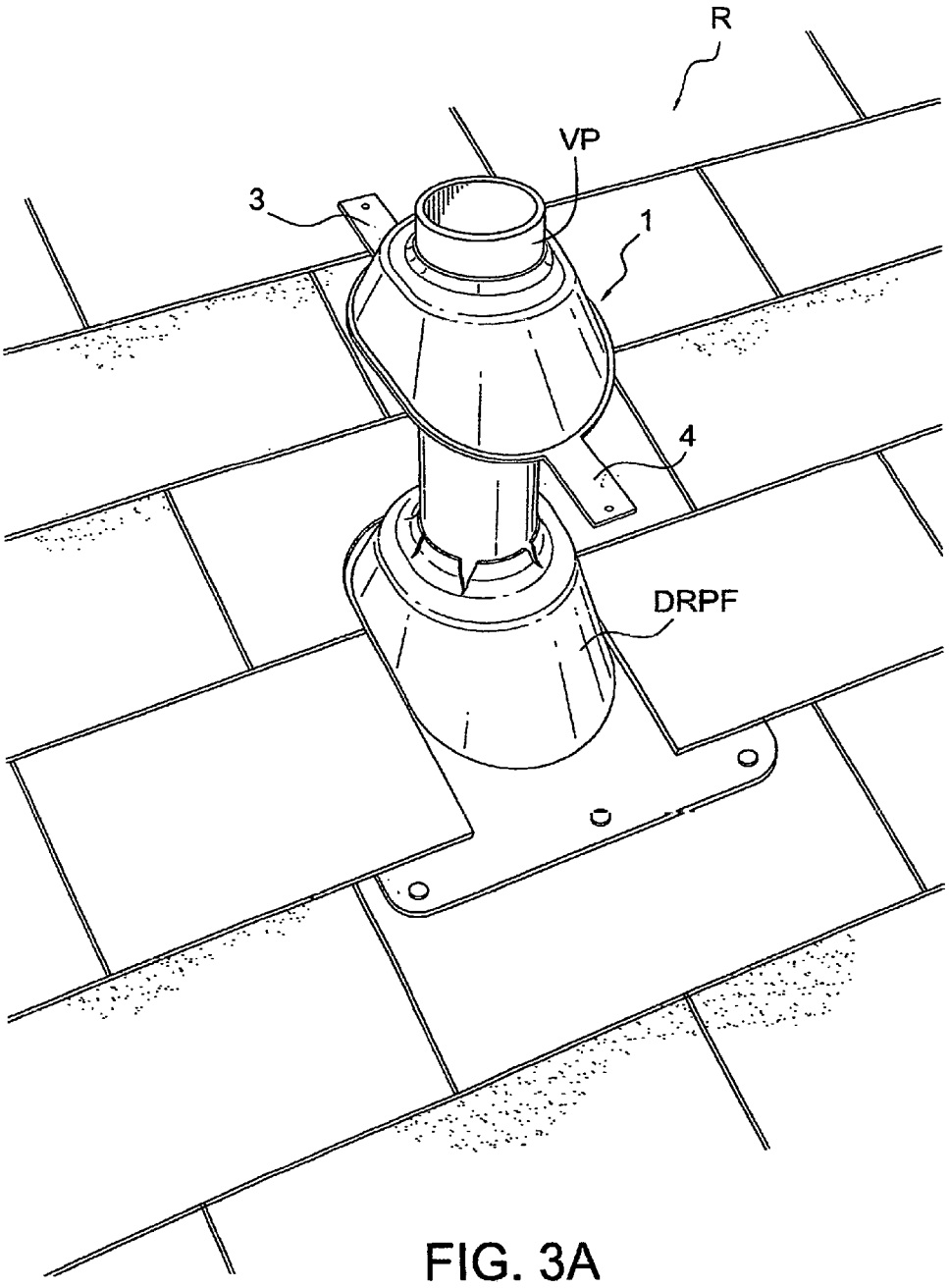
FIG. 3*a* is a perspective view of the roof pipe flashing of this invention being installed over the damaged boot of the roof pipe flashing of FIG. 1.
Figure 3B:
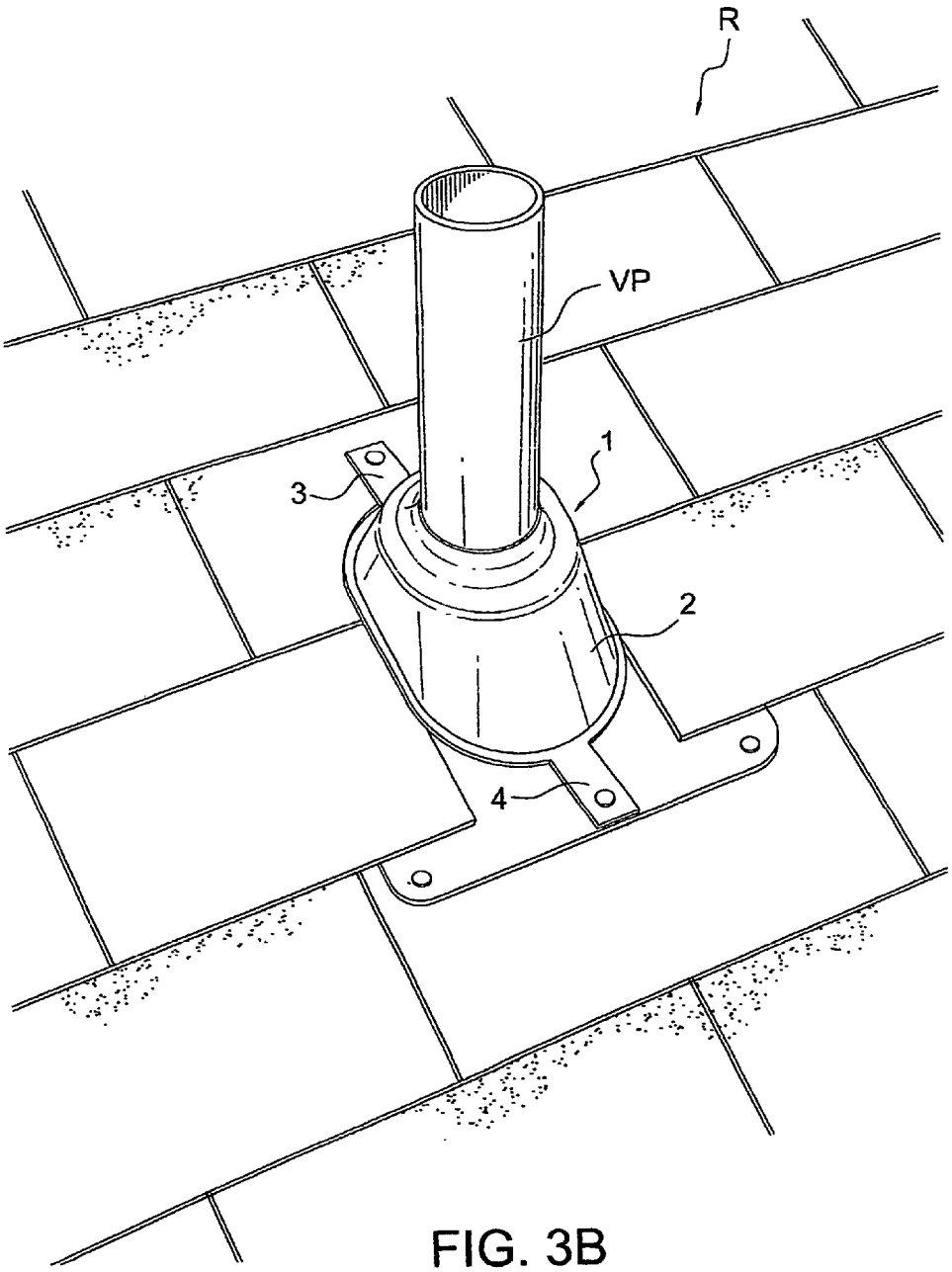
FIG. 3*b* is a perspective view of the roof pipe flashing of this invention with the cover boot being completely installed over the damaged boot of the roof pipe flashing of FIG. 1.

Referring now to FIG. 3*a*, there is shown the positioning of the roof pipe flashing 1 of this invention partially slid down over the vent pipe VP of a damaged roof pipe flashing (DRPF) on the pitched roof R of a building. In FIG. 3*b* there is shown the raised boot 2 of the present invention completely covering the damaged boot of the roof pipe flashing (DRPF) shown in FIG. 1. Also shown in FIG. 3*b* is the semi-closed top end 6 making a tight frictional engagement between the circumferential section surrounding the opening 6*a* and the outer cylindrical surface of the vent pipe VP which engagement will provide a weather-proof and water tight protection of the damaged roof pipe flashing (DRPF). The roof pipe flashing 1 of this invention is secured to the roof of the building by nails or screws at the free ends of the extensions 3 and 4 as shown in FIG. 3*b*. Each of the free ends of the extensions 3 and 4 may be initially provided with a hole to accommodate a nail or screw therethrough. In some instances the roof pipe flashing 1 of this invention may not completely cover the damaged roof pipe flashing DRPF all the way down to the roof R such that the bottom end 5 of the roof pipe flashing 1 is touching the roof shingles but that the raised boot 2 of the roof pipe flashing 1 of this invention is sufficiently covering a substantial portion of the damaged boot of the damaged roof pipe flashing DRPF by frictionally engaging and surrounding the vent pipe VP such that the roof pipe flashing 1 of this invention is effective in preventing water leakage therethrough or further weather damage thereto.

Figure 4:
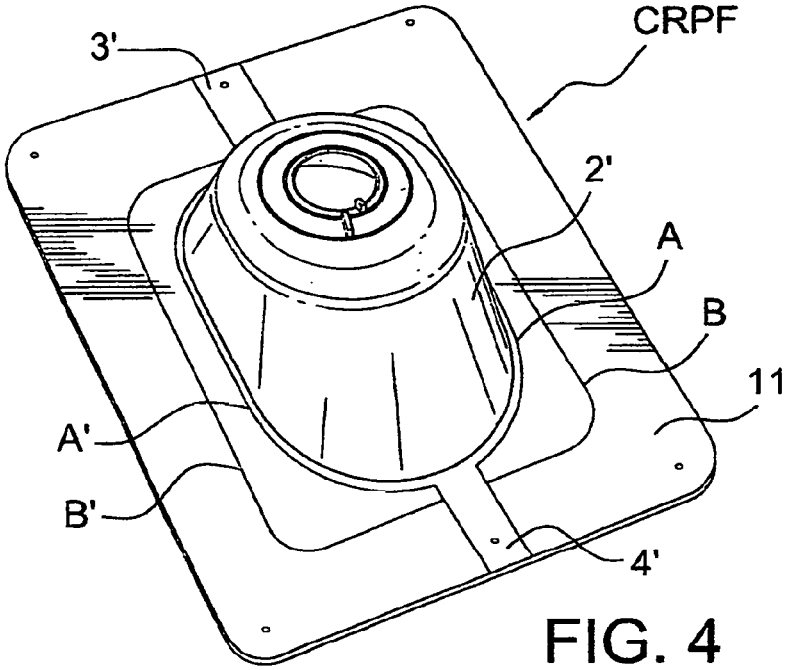
FIG. 4 is a perspective view of a conventional roof pipe flashing from which the roof pipe flashing of this invention can be manually fabricated.

FIG. 4 shows a conventional roof pipe flashing (CRPF) from which the roof pipe flashing 1 of this invention can be manually fabricated. The conventional roof pipe flashing (CRPF) includes a rectangular-shaped, flat support base 11, a frusto-conical shaped raised boot 2' extending therefrom and a cut-out or marked lines A, A' and B, B'on the upper surface of the flat support base 11. Details of the cut-out or marked lines A, A' and B, B' are explained more fully below with respect to FIG. 5. The rectangular-shaped, flat support base 11 has dimensions of approximately 12 inches by 15 inches. The raised boot 8 has an oval shaped bottom end whose dimensions are: approximately 7 and ¾ inches (major axis) and 5¼ inches (minor axis); a front wall length of approximately 4½ inches and a rear wall length of approximately 1¾ inches. The raised boot 2' has a domed shaped oval upper end with a central aperture for the roof vent pipe VP. The dimensions of the domed shaped oval upper end are: approximately 5½ inches (major axis) and 4 and ¾ inches (minor axis) and a central opening diameter of approximately 1 and ⅜ inches. These dimensions can vary depending on the size of the roof pipe flashing used but generally these dimensions are appropriate for the conventional roof pipe flashing used on housing roofs today. The domed shaped upper end of the boot 2' is at an angle with respect to the bottom oval end of the boot 2'. The conventional roof pipe flashing (CRPF) is made from an elastomeric material. An example of a conventional roof pipe flashing (CRPF) that can be used for the present invention is disclosed in U.S. Pat. No. 4,903,997.

Figure 5:
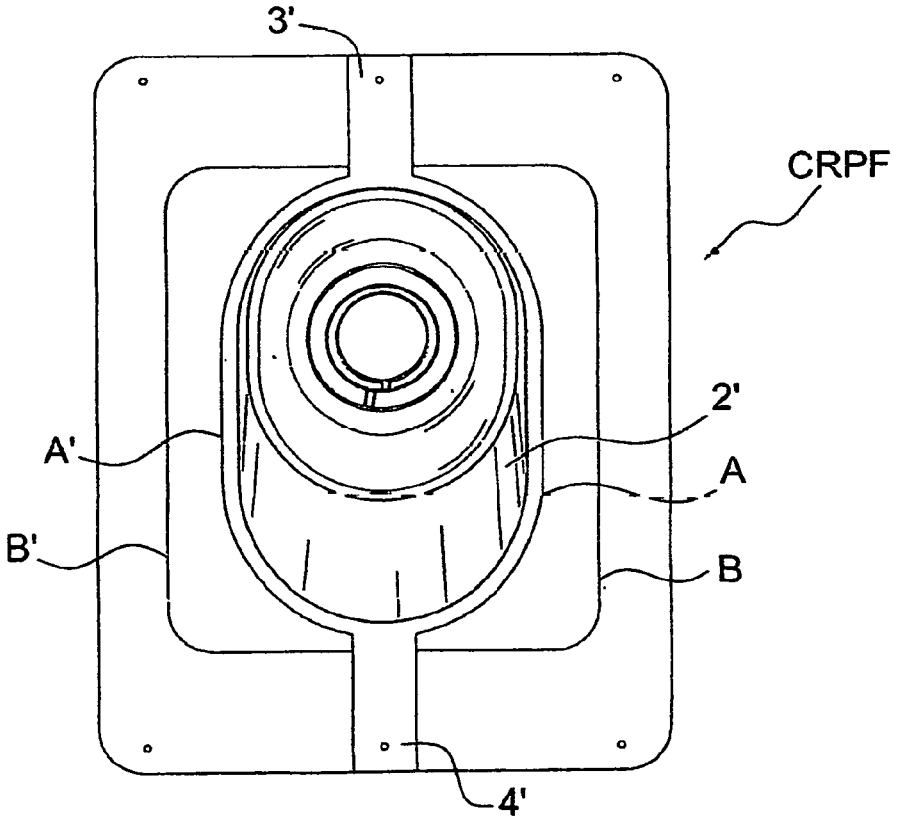
FIG. 5 is a top planar view of the roof pipe flashing shown In FIG. 4 showing cut-out lines on the base thereof by which the roof pipe flashing of this invention can be manually fabricated.

FIG. 5 shows a top planar view of a pre-marked conventional roof pipe flashing (CRPF) from which the roof pipe flashing 1 of this invention can be manually fabricated. The cut-out or marked lines A, A' and B, B' are clearly shown on the flat support base 11. The cut-out or marked lines A, A' surround opposite sides of the raised boot 2' at approximately ⅜ inch from the bottom end 5 thereof but can be varied therefrom and also outlines two opposite extensions 3' and 4' extending therefrom. Each of the opposite extensions 3' and 4' is approximately 3 inches long and 2 inches wide but these dimensions can be varied. The cut-out or marked lines A, A' and B, B' can be color coated lines, raised lines or shallow engraved lines. Cut-out or marked lines A, A' indicate the directions for cutting out or tearing out the roof pipe flashing 1 of the present invention as shown in FIG. 2 of the drawing. Although only two sets of cut-out or marked lines are particularly described herein other configurations of cut-out or marked lines on the flat support base 11 could also be used provided that the opposite extensions 3' and 4' from the bottom end 5 of the raised boot 2' are maintained. It is also possible to only have cut-out or marked lines on the flat support base 11 defining the two opposite extensions 3' and 4' with no marked lines spaced around the bottom end 5 of the raised boot 2'.

Figure 6:
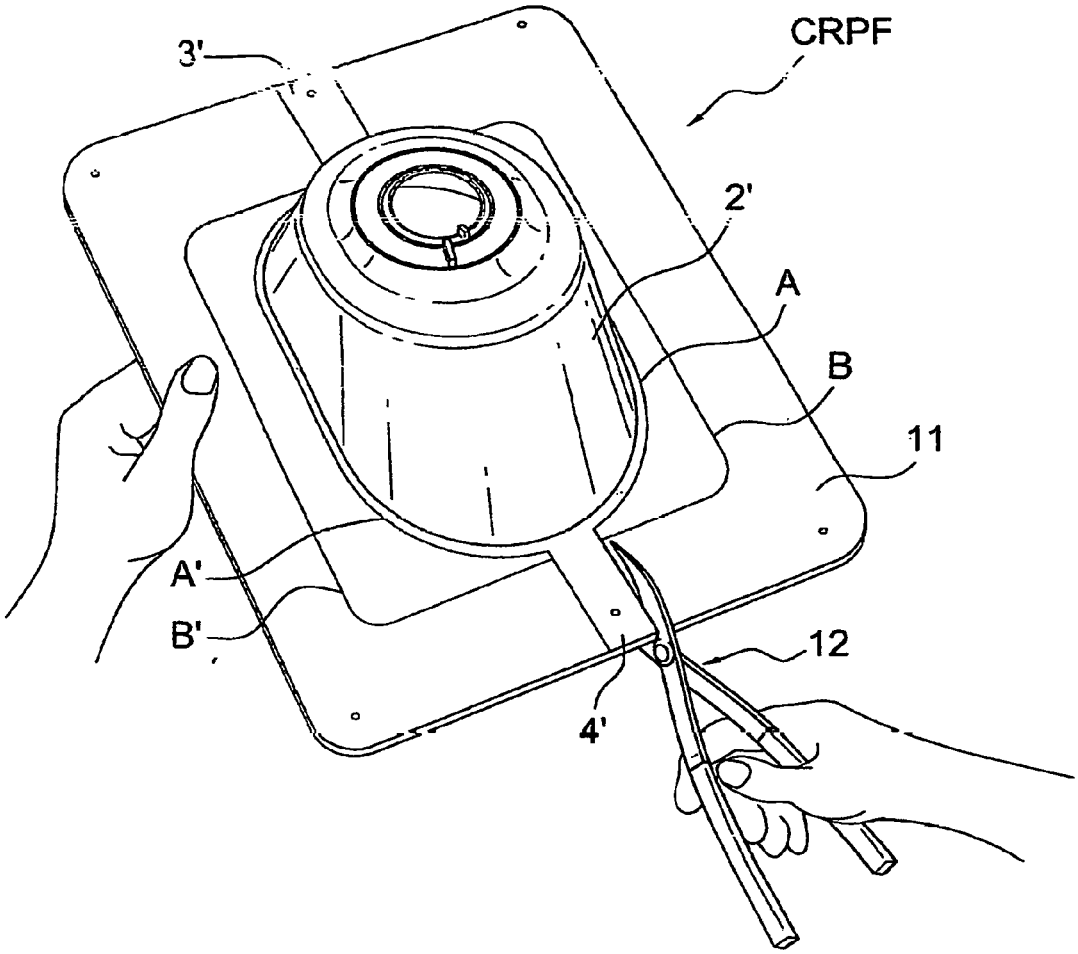
FIG. 6 shows the use of a construction snips for cutting the roof pipe flashing along the cut-out lines of the roof pipe flashing of this invention.

Referring now to FIG. 6, there is shown one method for manually fabricating the roof pipe flashing 1 of this invention by simply and separately cutting along each marked line A and A' with a pair of construction snips 12 or other known cutting tools by holding the flat support base 11 with one hand and separately cutting along each marked line A and A' with the construction snips 12 in the opposite hand. The roof pipe flashing 1 of this invention, as shown in FIG. 2, will result by effecting this cutting procedure.

As an alternative method for manually fabricating the roof pipe flashing 1 of this invention, each marked line A and A' can be a hollow engraved line which is tearable by hand. In which case, the roofer or construction worker can separately tear opposite sections of the flat support base 11 by using both hands such that the roof pipe flashing 1 of this invention, as shown in FIG. 2, will result.

An alternative roof pipe flashing 1'of this invention can be realized by manually cutting or tearing out the base sections of the flat support base 11 along the marked lines B and B' in which case a reduced rectangular base supporting a raised boot 2' with opposite extensions 3' and 4' will result. This resulting roof pipe flashing 1' would also be effective in covering and repairing an existing but damaged roof pipe flashing (DRPF) in a manner similar to the roof pipe flashing 1.

It is also intended to use the pre-marked roof pipe flashing of this invention in the new construction for a roof of a building.

Although the present specification discloses methods by which the roof pipe flashing 1 of this invention can be manually fabricated from a conventional roof pipe flashing, the roof pipe flashing 1 of this invention could also be pre-fabricated at a factory using mechanized cutting or tearing techniques well known in the manufacturing art.

Modification of this invention will be readily apparent to those skilled in the art and it is intended that the invention be not limited by the embodiments disclosed herein but that the scope of the invention be defined by the appended claims.

What is claimed is:

1. A method of making a modified roof pipe flashing on site comprising the steps of:

a) obtaining a pre-marked available roof pipe flashing having a substantially rectangular flat base with a central opening therein, a substantially frusto-conical boot with an opening at a bottom end thereof matching the size and shape of said central opening in said substantially rectangular flat base, said central opening having a minor axis with a predetermined first length, said substantially frusto-conical boot having a semi-closed top end with an opening therein for insertion of a roof vent pipe, said bottom end of said substantially frusto-conical boot being integrally attached to said substantially rectangular flat base around said central opening in said substantially rectangular flat base, said substantially frusto-conical boot rising above said upper surface of said substantially rectangular flat base, such that said semi-closed end of said substantially frusto-conical boot is at a physically higher level than said upper surface of said substantially rectangular flat base, said substantially rectangular flat base having four outer straight edges designated successively as a north straight edge, a south straight edge, an east straight edge and a west straight edge, a pair of oppositely spaced marked lines in said upper surface of said substantially rectangular flat base, each of said pair of oppositely spaced marked lines extending from said south straight edge of said substantially rectangular flat base, continuing around said bottom end of said substantially frusto-conical boot at a predetermined distance and ending at said north straight edge of said substantially rectangular flat base, each of said pair of oppositely spaced marked lines defining an elongated extension opposite each other such that each of said elongated extensions has a predetermined second length along its width that is less than said first length and an outwardly lateral flat extension of said predetermined distance substantially surrounding said bottom end of said substantially frusto-conical boot, b) manually holding said substantially rectangular flat base in one hand;

c) manually taking a cutting means in an opposite hand; and cutting along each of said oppositely spaced marked lines;

d) cutting along each of said oppositely spaced marked lines starting from said south straight edge of said substantially rectangular flat base, and cutting at said predetermined distance around said bottom end of said substantially frusto-conical boot, and finally continue cutting up to said north straight edge of said substantially rectangular flat base thereby resulting in said modified roof pipe flashing comprising a substantially frusto-conical boot rising above said upper surface of said substantially rectangular flat base with a pair of elongated extensions extending oppositely from said bottom end of said substantially frusto-conical boot and an outwardly lateral flat extension extending at a predetermined distance from said bottom end of said substantially frusto-conical boot.

2. The method of claim 1 wherein said cutting means is a pair of snips.

3. The method of claim 1 wherein each of said pair of oppositely spaced marked lines is selected from a group consisting of a color coating line, a raised line and a shallow engraved line.

4. The method of claim 1 wherein the material of said modified roof pipe flashing is selected from a group consisting of soft rubbers, hard plastics and elastomeric materials.

5. The method of claim 1 wherein at least one of said pair of oppositely elongated extensions has a small opening therein near a free end thereof for passing a nail or screw therethrough for securing said modified roof pipe flashing to a roof of a building.

6. A method of making a modified roof pipe flashing on site comprising the steps of:

a) obtaining a pre-marked available roof pipe flashing having a substantially rectangular flat base with a central opening therein, said substantially rectangular flat base having an upper surface and a lower surface, a substantially frusto-conical boot with an opening at a bottom end thereof matching the size and shape of said central opening in said substantially rectangular flat base, said central opening having a minor axis with a predetermined first length, said substantially frusto-conical boot having a semi-closed top end with an opening therein for insertion of a roof vent pipe, said bottom end of said substantially frusto-conical boot being attached to said substantially rectangular flat base around said central opening in said substantially rectangular flat base, said substantially rectangular flat base having four straight edges oriented north, south, east and west, a pair of oppositely spaced marked lines in said upper surface of said substantially rectangular flat base, each of said pair of oppositely spaced marked lines extending from said south straight edge of said substantially rectangular flat base, continuing around said bottom end of said substantially frusto-conical boot at a predetermined distance and ending at said north straight edge of said substantially rectangular flat base, each of said pair of oppositely spaced marked lines being a tearable shallow engraved line, each of said pair of oppositely spaced marked lines defining an elongated extension opposite each other such that each of said elongated extensions has a predetermined second length along its width that is less than said first width and an outwardly lateral flat extension of said predetermined distance substantially surrounding said bottom end of said substantially frusto-conical boot, b) manually holding said substantially rectangular flat base in one hand; and c) manually tearing with an opposite hand, along each of said tearable shallow engraved lines starting from said south straight edge of said substantially rectangular flat base, continuing along and around said bottom end of said frusto-conical boot at said predetermined distance and ending at said north straight edge of said substantially rectangular flat base, thereby resulting in said modified roof pipe flashing comprising a substantially frusto-conical boot with a pair of oppositely extending extensions and an outwardly lateral flat extension extending at a predetermined distance from said bottom end of said substantially frusto-conical boot.

7. The method of claim 6 wherein the material of said modified roof pipe flashing is selected from a group consisting of soft rubbers, hard plastics and elastomeric materials.

8. The method of claim 6 wherein at least one of said pair of oppositely elongated extensions has a small opening therein near a free end thereof for passing a nail or screw therethrough for securing said modified roof pipe flashing to a roof of a building.

* * * * *